US009470449B2

(12) United States Patent
Lehner et al.

(10) Patent No.: US 9,470,449 B2
(45) Date of Patent: Oct. 18, 2016

(54) ARRANGEMENT, USE OF AN ARRANGEMENT, DEVICE, SNOW LANCE AND METHOD FOR PRODUCING ICE NUCLEI AND ARTIFICIAL SNOW

(75) Inventors: Daniela Lehner, Graenichen (CH); Mathieu Fauve, Davos Platz (CH); Bruno Koch, Emmenbrücke (CH); Claus Dangel, Ennetbürgen (CH)

(73) Assignee: BAECHLER TOP TRACK AG, Auw (CH)

( * ) Notice: Subject to any disclaimer, the term of this patent is extended or adjusted under 35 U.S.C. 154(b) by 712 days.

(21) Appl. No.: 12/747,980

(22) PCT Filed: Jul. 8, 2008

(86) PCT No.: PCT/EP2008/058863

§ 371 (c)(1),
(2), (4) Date: Oct. 22, 2010

(87) PCT Pub. No.: WO2009/077211

PCT Pub. Date: Jun. 25, 2009

(65) Prior Publication Data

US 2011/0049258 A1 Mar. 3, 2011

(30) Foreign Application Priority Data

Dec. 14, 2007 (EP) ..... 07123230

(51) Int. Cl.
*F25C 3/04* (2006.01)
*B05B 7/08* (2006.01)

(52) U.S. Cl.
CPC ..... *F25C 3/04* (2013.01); *B05B 7/0853* (2013.01); *F25C 2303/0481* (2013.01)

(58) Field of Classification Search
CPC ..... B05B 7/08; B05B 7/0807; B05B 7/0853; F25C 3/00; F25C 3/04; F25C 2303/00; F25C 2303/048; F25C 2303/0481
USPC ..... 239/14.2, 419, 419.3, 433
See application file for complete search history.

(56) References Cited

U.S. PATENT DOCUMENTS

| | | | |
|---|---|---|---|
| 3,301,485 | A | 1/1967 | Tropeano et al. |
| 3,716,190 | A | 2/1973 | Lindlof |
| 3,908,903 | A | 9/1975 | Burns, Jr. |
| 3,969,908 | A | 7/1976 | Lawless |

(Continued)

FOREIGN PATENT DOCUMENTS

| | | |
|---|---|---|
| CA | 2015646 | 10/1991 |
| DE | 2941052 | 3/1981 |

(Continued)

*Primary Examiner* — Christopher Kim
(74) *Attorney, Agent, or Firm* — Davis & Bujold PLLC; Michael J. Bujold

(57) ABSTRACT

A nucleator nozzle (20) for producing ice nuclei is designed as convergent-divergent nozzle. The nozzle channel (25) has a section (27) that is widening. The ratio of the cross-sectional area of the outlet opening (23) to the cross-sectional area of the nozzle channel (25) in the region of the nucleus diameter (26) is at least approximately 4:1. A snow lance (1) having at least one nucleator nozzle (20) and having at least one water nozzle (30; 30') is designed such that water droplets (32) produced by the water nozzle (30; 30') pass through a droplet path (31; 31') of at least 20 cm until they reach ice nuclei (28) from the nucleator nozzle (20) in a germination zone E.

18 Claims, 11 Drawing Sheets

(56) References Cited

U.S. PATENT DOCUMENTS

Figure 1:
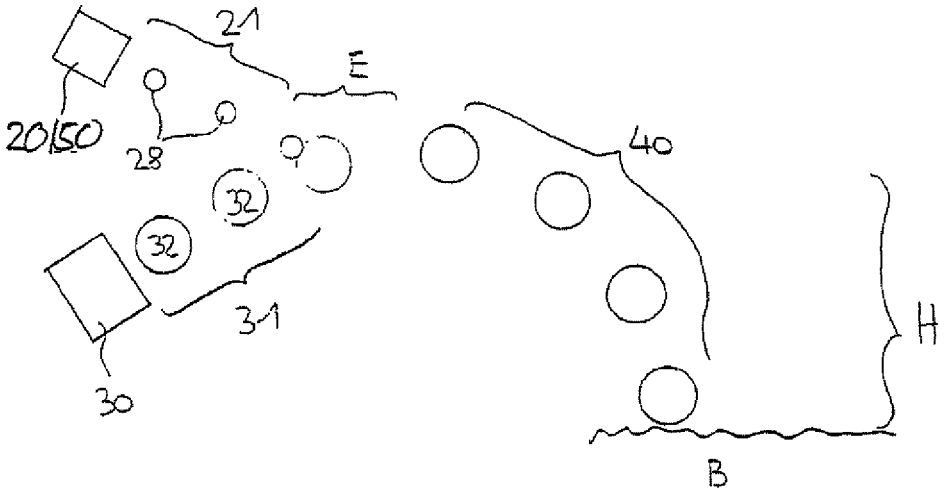

| | | | | | |
|---|---|---|---|---|---|
| 4,004,732 | A | * | 1/1977 | Hanson | 239/2.2 |
| 4,145,000 | A | | 3/1979 | Smith et al. | |
| 4,353,504 | A | | 10/1982 | Girardin et al. | |
| 4,383,646 | A | | 5/1983 | Smith | |
| 4,465,230 | A | | 8/1984 | Ash | |
| 4,516,722 | A | | 5/1985 | Avery | |
| 4,742,959 | A | | 5/1988 | Stanchak et al. | |
| 4,793,554 | A | | 12/1988 | Kraus | |
| 4,903,895 | A | | 2/1990 | Mathewson | |
| 4,915,302 | A | | 4/1990 | Kraus | |
| 5,004,151 | A | | 4/1991 | Dupre | |
| 5,090,619 | A | | 2/1992 | Barthold et al. | |
| 5,154,348 | A | | 10/1992 | Ratnik | |
| 5,520,331 | A | | 5/1996 | Wolfe | |
| 5,529,242 | A | | 6/1996 | Hedin | |
| 5,593,090 | A | | 1/1997 | Werner | |
| 5,810,251 | A | | 9/1998 | McKinney | |
| 5,823,427 | A | * | 10/1998 | Dupre | F25C 3/04 239/14.2 |
| 5,836,513 | A | * | 11/1998 | Smith | F25C 3/04 239/14.2 |
| 5,909,844 | A | | 6/1999 | Nilsson | |
| 5,934,556 | A | | 8/1999 | Charriau et al. | |
| 6,032,872 | A | | 3/2000 | Dupre | |
| 6,119,956 | A | | 9/2000 | McKinney | |
| 6,129,290 | A | * | 10/2000 | Nikkanen | 239/2.2 |
| 6,152,380 | A | | 11/2000 | Dupre | |
| 6,182,905 | B1 | | 2/2001 | Dupre | |
| 6,508,412 | B1 | | 1/2003 | Pergay et al. | |
| 6,719,209 | B1 | * | 4/2004 | Pergay et al. | 239/14.2 |
| 7,114,662 | B1 | | 10/2006 | Nikkanen | |
| 2004/0046041 | A1 | | 3/2004 | Dupre | |
| 2004/0112976 | A1 | | 6/2004 | Galvin | |
| 2006/0071091 | A1 | | 4/2006 | Ratnik | |

FOREIGN PATENT DOCUMENTS

| | | |
|---|---|---|
| DE | 4106419 | 8/1991 |
| DE | 19819982 | 9/1999 |
| DE | 19838785 | 3/2000 |
| DE | 10215580 | 10/2003 |
| DE | 102004053984 | 6/2006 |
| EP | 787959 | 8/1997 |
| EP | 1283400 | 2/2003 |
| EP | 1473528 | 11/2004 |
| FR | 2594528 | 8/1987 |
| FR | 2617273 | 12/1988 |
| FR | 2877076 | 4/2006 |
| GB | 2214108 | 8/1999 |
| JP | 2005127577 | 10/2003 |
| WO | 90/12264 | 10/1990 |
| WO | 94/19655 | 9/1994 |
| WO | 03/054460 | 7/2003 |
| WO | 2004/087329 | 10/2004 |

* cited by examiner

ARRANGEMENT, USE OF AN ARRANGEMENT, DEVICE, SNOW LANCE AND METHOD FOR PRODUCING ICE NUCLEI AND ARTIFICIAL SNOW

The invention relates to an arrangement, in particular to a nucleator nozzle, to the use of an arrangement, to a device, to a snow lance and to a method for producing ice nuclei and artificial snow as per the preamble of the independent patent claims.

The production of artificial snow has long been known. Snow guns or snow lances are used nowadays in a multiplicity of forms, in particular in winter sports areas. According to one known method, a jet of ice nuclei is produced in a "nucleator nozzle" and is brought into contact with a jet composed of water droplets. By means of said "germination", snow is produced from the cooling water droplets.

In order to produce the ice nuclei, water is cooled and atomized with the use of compressed air. An essential parameter for economical operation of nucleator nozzles of this type is the quantity of compressed air which has to be used to achieve the desired effect. The quantity of compressed air determines the energy input and ultimately the operating costs. A further essential operating parameter relates to the wet bulb temperature of the surroundings. With known snow lances, artificial snow can be produced up to approx. −3 to −4°. The aim is to be able, if possible, to produce artificial snow even at higher temperatures without greater energy input.

To produce ice nuclei, convergent nucleator nozzles, for example, are known, in which the cross section in the nozzle channel becomes continuously narrower in the direction of the exit: corresponding nozzles are known, for example, from FR 2 617 273, U.S. Pat. No. 4,145,000, U.S. Pat. No. 4,516,722, U.S. Pat. No. 3,908,903 or FR 2 594 528. In addition, convergent-divergent nucleator nozzles in accordance with the Laval principal are also known. Nucleator nozzles of this type are shown, for example, in U.S. Pat. No. 4,903,895, U.S. Pat. No. 3,716,190, U.S. Pat. No. 4,793,554 or in U.S. Pat. No. 4,383,646. However, all of said known nucleator nozzles require a relatively large energy input in order to produce the nuclei.

To produce artificial snow, nozzle designs which are combined directly with water nozzles are also known. Corresponding solutions are known from US 2006/0071091, U.S. Pat. No. 5,090,619, U.S. Pat. No. 5,909,844, WO 94/19655 or U.S. Pat. No. 5,529,242 and WO 90/12264. For example, the nozzle according to U.S. Pat. No. 5,090,619 produces a bubbly flow, and therefore, in practice, only a very small proportion of the water conducted through the nozzle can be converted into ice at the nozzle outlet. The applicant estimates the mass flow ratio (ALR; ratio of the mass flows of air to water) to be only approx. 0.01. Said nozzle is therefore not suitable as a nucleator nozzle for producing ice nuclei.

U.S. Pat. No. 5,593,090 shows an arrangement in which a multiplicity of water nozzles is arranged next to one another.

Snow lances in which nucleator nozzles and water nozzles are arranged adjacent to one another on a lance body such that the ice nuclei and water droplets produced are brought into contact with one another in a germination zone adjacent to the lance body are generally customary. Solutions of this type are shown, for example, in DE 10 2004 053 984 B3, U.S. Pat. No. 6,508,412, U.S. Pat. No. 6,182,905, U.S. Pat. No. 6,032,872, U.S. Pat. No. 7,114,662 and U.S. Pat. No. 5,810,251.

Further snow lances are described in U.S. Pat. No. 5,004,151, U.S. Pat. No. 5,810,251 or FR 2 877 076.

However, the known nucleator nozzles and snow lances have drawbacks. In particular, they can be used only at relatively low outside temperatures and water temperatures.

Therefore, it is an object of the present invention to avoid the drawbacks of what is known, and therefore in particular to provide an arrangement, a device, a snow lance and a method for producing ice nuclei and artificial snow, which permit the production of artificial snow with as little energy input as possible and at as high outside temperatures and water temperatures as possible.

According to the invention, this and other objects are achieved in accordance with the characterizing part of the independent patent claims.

The nucleator nozzle according to the invention serves to produce ice nuclei. The nucleator nozzle has a nozzle channel which is provided with at least one compressed air inlet opening and with at least one water inlet opening. The water introduced into the nozzle channel through the water inlet opening is accelerated by the compressed air and output via an outlet opening of the nucleator nozzle and, in the process, atomized.

The cross section of the nozzle channel tapers in a first section in the direction of the outlet opening to a core diameter. The cross section of the nozzle channel subsequently expands again in a second section in the direction of the outlet opening. The nucleator nozzle is therefore a convergent-divergent nozzle.

According to the invention, the ratio between the cross sectional area of the outlet opening and the cross sectional area of the nozzle channel in the region of the core diameter is at least approximately 4:1, preferably approximately 9:1. It has been shown that the effectiveness of the nucleator nozzle can be significantly increased and the energy input required significantly reduced with a nozzle geometry of this type. The geometry of the nozzle in the expanding second section is selected in such a manner that, during operation, a negative pressure is produced in said section. As a result, a lower temperature of the compressed air is reached in the nozzle, and therefore the water temperature can also be lowered further. This has the advantage that, even in the case of high water temperatures of up to 10° C., sufficient cooling is still achieved in the nozzle without the ratio of mass flow of air to water having to be increased. At the same time, the geometry leads to the formation of surges in the emerging medium downstream of the outlet opening because of the pressure compensation. Surges occur whenever the outlet pressure of the nozzle does not exactly correspond to the ambient pressure. It is ensured with the high area ratio that the surges occur only when the compressed air is used optimally.

It is presumed that, with the nucleator nozzle according to the invention, the conversion energy for producing the ice nuclei arises only from a slight supercooling. At the same time, the surges which are formed in a targeted manner downstream of the outlet opening serve to initiate solidification of the ice nuclei.

Nucleator nozzles having different area ratios have been exposed to extreme conditions in the air conditioning channel, i.e. to high ambient temperatures, very high water temperatures and to a high proportion of water in the nucleator nozzle. Under such conditions, an ice nuclei hail was still noticeable in the case of nucleator nozzles having a high area ratio.

The full angle of the nozzle channel is at most 30°, preferably approximately 10 to 20°.

It has been shown that optimum results are produced given such an expansion and length of the nozzle channel. In particular, a certain length of the nozzle channel in the expanding region is required so that the compressed air which cools during acceleration can sufficiently cool the entrained water droplets. A sufficient amount of time is needed for said compensating process.

However, the nozzle geometry described above is also advantageous for a larger arrangement for producing ice nuclei. Said arrangement may comprise a nozzle part in which water and compressed air are not input via separate openings, but rather via at least one common nozzle inlet opening for a water-air mixture which is already present. Of course, however, the arrangement also contains at least one compressed air inlet opening and at least one water inlet opening. In this case, the compressed air inlet opening and water inlet opening may be located outside the nozzle part. This arrangement therefore contains one or more nozzle channels, wherein the respective cross section of the nozzle channel tapers in a first section in the direction of the outlet opening to a core diameter, and wherein the cross section of the nozzle channel subsequently expands in a second section in the direction of the outlet opening, wherein the ratio of the cross sectional area of the outlet opening to the cross sectional area of the nozzle channel in the region of the core diameter is at least 4:1, preferably approximately 9:1. Since ice nuclei can also be produced with said nozzle part, the term "nucleator nozzle" is likewise used below for the sake of simplicity.

According to an alternative aspect of the invention, the nozzle channel of a nucleator nozzle in the expanding section is designed in such a manner that, during operation of the nozzle, a pressure of less than 0.6 bar, preferably approximately 0.2 bar, is set in the expanding section. At the same time, the nozzle channel is designed in such a manner that, downstream of the outlet opening, pressure surges arise in the outflowing medium. In the case of a nucleator nozzle configured specifically for achieving said operating condition, the consumption of compressed air can be massively reduced.

Depending on the application, the nucleator nozzle may be designed as a circular jet nozzle or else as a fan jet nozzle.

In the case of the nucleator nozzle according to the invention, the water inlet opening is typically arranged laterally on the nozzle channel. The water preferably enters the nozzle channel at an angle of 90°.

An advantageous nucleator nozzle can be produced if, for the formation of a mixing chamber, the nozzle channel has an approximately cylindrical section which is adjoined by the tapering first section. In this case, the water inlet opening may be arranged in the cylindrical section. The water inlet opening may be arranged approximately centrally in the cylindrical section, for example with respect to the axial direction.

In a preferred embodiment, the corresponding mixing section between the water inlet opening and the first tapering section may be greater than twice the diameter of the compressed air inlet opening (which corresponds to the diameter of the cylindrical section) and particularly preferably at least three times said diameter in order to permit the formation of a droplet flow which is as homogeneous as possible.

In a preferred embodiment, the nozzle channel or the arrangement overall can be configured in such a manner that a fine dispersion or droplet flow is produced in the region of the mixing section. With said flow form, particularly fine atomization is possible, resulting in a large number of ice nuclei.

The nozzle channel can be dimensioned as a function of the cross section of the one or more water inlet openings and the cross sectional area in the region of the core diameter of the one or more nucleator nozzles in such a manner that, in the pressure ranges customary in the snow-making trade, a ratio of the mass flows of air to water (ALR) within the range of 0.3 to 1.9 and particularly preferably of 0.3 to 1.7 (for example ALR=0.6 or ALR=1.9) is or can be set. In the snow-making trade, nucleator nozzles are customarily operated at water pressures of 12 to 60 bar abs., and air pressures of 7 to 10 bar abs. Within said range of the mass flow ratio, a large number of ice nuclei can be produced and, with the nucleator nozzle described, the freezing of the minuscule water droplets to form ice nuclei can still be guaranteed even in critical temperature ranges (water temperature of up to 10° C. and wet bulb temperature of the air of up to −0.5° C.).

In order to obtain mass flow ratios in the range of 0.3 to 1.7 and therefore to achieve optimum formation of ice nuclei, the ratio of the cross sectional area of the nozzle channel in the region of the core diameter to the cross sectional area of the one or more water inlet openings lies within the range of 8:1 to 40:1 and preferably approximately 32:1. Area ratios of 9:1 have proven particularly advantageous for ratios of the absolute pressures of water to air in the range of 1.2 to 3, and area ratios of 35:1 have proven particularly advantageous at pressure ratios of 3 to 8. If the arrangement has, for example, a plurality of nozzle channels with corresponding core diameters, the overall cross sectional area of the core diameters is to be selected as reference variable for the abovementioned ratio of the cross sectional areas.

It may be advantageous for certain applications if the channel section having the narrowest cross section and/or the adjoining, expanding section is/are configured to be relatively long. The water droplets therefore have sufficient time for cooling, as a result of which the production of ice nuclei can be optimized. The length (LE) of the channel section having the narrowest cross section can be, for example, at least twice, preferably five times and particularly preferably at least ten times the core diameter.

It may be advantageous, particularly in a structural respect, if the nucleator nozzle is predetermined by a component designed as a single piece. A component of this type can also be easily fitted, for example, into a snow lance.

In an advantageous embodiment, the arrangement can have at least two, and preferably three outlet openings. The outlet openings can each preferably be assigned to a nucleator nozzle. The outlet openings can be connected via a channel division to a common mixing chamber into which air and water for the air-water mixture can be fed via the at least one compressed air inlet opening and via at least one water inlet opening. In this arrangement, the nucleator nozzles have a common input for the compressed air and the water (instead of separate compressed air inlet openings and water inlet openings).

A mixing chamber, the cross sectional area of which is at most 9 times, preferably approximately 7 times, larger than the cross sectional area in the region of the core diameter is particularly advantageous. The mixing section can correspond to at least 5 times, preferably at least 12 times, the inside diameter of the mixing chamber. A particularly homogeneous droplet flow and, in association therewith, very fine atomization can be achieved with a mixing chamber of this type. Fine atomization leads to a large number of droplets and, together with the very rapidly cooling droplets in the finely dispersed droplet flow, to a large number of ice nuclei. Such a tubular part for forming a mixing chamber may also be advantageous in combination with conventional nucleator nozzles.

The mixing chamber can be formed by an approximately hollow cylindrical tubular part, the at least one compressed air inlet opening being arranged on the end side of the tubular part and the at least one water inlet opening being arranged on the casing side in or on the tubular part. Of course, it is conceivable to select different shapes instead of a hollow cylindrical tubular part. In particular, the external shape of the tubular part does not absolutely have to be cylindrical or partially cylindrical.

A filter means can be arranged at least in the region of the at least one water inlet opening, in particular on the outer casing of the tubular part. The at least one water inlet opening could be closed in each case by an individual filter element. However, it is particularly advantageous if the filter means is a sleeve-shaped filter element which is arranged at a distance around the tubular part in order to form an annular gap space. Said filter arrangement firstly produces a good filtering effect and, secondly, the outlay on maintenance can be considerably reduced. In the case of an arrangement having a channel division, it may be advantageous if a common filter means (instead of a respective filter means per nucleator nozzle) is used for feeding the plurality of nucleator nozzles. A central filter means of this type may be designed to be relatively coarse (for example to have relatively large mesh widths).

In order to bring up the water to the nozzle channel, the arrangement can have at least one preferably tubular or cross sectionally annular water pipe which runs parallel to the tubular part and is provided with at least one passage bore, water being feedable into the at least one water inlet opening via one or more passage bores.

The tubular part and the nucleator nozzles assigned to the outlet openings may be oriented approximately at a right angle to one another. The air-water mixture is therefore deflected approximately at right angles in the nozzle channel, thus enabling a space-saving arrangement to be achieved.

The outlet openings can be assigned nucleator nozzles which are distributed on a circumference about an axis and which are each directed away radially. An arrangement of this type is suitable in particular for fitting into a snow lance.

It may be particularly advantageous in this case if the arrangement has a head part to which the nucleator nozzles are or can be fastened, preferably via a screw connection. The head part can have, in order to form the channel division, a central channel which runs in the direction of the axis thereof and is divided into supply channels which are directly away radially from the axis and are intended for feeding the respective nucleator nozzles.

A further aspect relates to the use of an arrangement as described above, in particular of the above-described nucleator nozzle, for producing ice nuclei for a device for producing artificial snow. Accordingly, yet another aspect of the invention relates to a device for producing artificial snow, such as, for example, to a snow lance or snow gun having at least one nucleator nozzle of this type.

Another aspect of the invention also relates to a snow lance having at least one arrangement for producing ice nuclei, in particular at least one nucleator nozzle and at least one water nozzle for producing water droplets. A nucleator nozzle in the above-described form is typically but not necessarily used. Ice nuclei can be produced with the nucleator nozzle. A droplet jet composed of water droplets can be produced with the water nozzle. After passing through an ice nuclei section and after passing through a droplet section, respectively, the ice nuclei jet and the droplet jet meet in a germination zone. According to this aspect of the invention, the snow lance is designed in such a manner that the ice nuclei section is at least 10 cm, preferably approximately 20 to 30 cm. As an alternative or also at the same time, the droplet section is at least 20 cm, preferably approximately 40 to 80 cm.

The ice nuclei sections and droplet sections which are relatively long in comparison to the prior art respectively permit better full freezing of the ice nuclei droplets, which are only extremely lightly frozen after emerging from the nucleator nozzle, and better cooling of the water droplets produced from the water nozzle. The longer droplet section permits greater dissipation of energy to the surroundings by convection and evaporation. Since the water droplets can be cooled relatively strongly in this manner (optimally to below 0° C.), the ice nuclei do not melt in contact with the water droplets. Whereas in trials a droplet section of 20 to 80 cm has proven particularly advantageous, a further lengthening of the droplet section would in principle be conceivable. In general, it is attempted to design the droplet section to be as long as possible, but it should be ensured that the droplet jet does not expand excessively.

It has surprisingly been shown that the maximum snow-making temperature (wet bulb temperature) with the arrangement according to the invention can be increased by 2 to 3° Celsius. Typically, the snow-making limit with the snow lance according to the invention is approx. −1° in comparison to a snow-making limit of −3 to −4° in the case of snow lances according to the prior art. In addition, a massive reduction of the air consumption by at least 50% in comparison to the prior art could be achieved with the arrangement according to the invention and the nucleator nozzle according to the invention.

The snow lance preferably has a lance body with a substantially cylindrical shape. In this case, the nucleator nozzle is arranged radially or is directed obliquely upward up to an angle of 45°, i.e. away from the lance body, with respect to the axis of the lance body. Here and below, the discussion involves one nucleator nozzle or one water nozzle. Of course, the embodiments below also relate to arrangements having more than one nucleator nozzle or more than one water nozzle.

According to another preferred exemplary embodiment, the water nozzle is arranged at an angle to a plane perpendicular to the axis of the lance body. In this case, the water nozzle is directed toward the nucleator nozzle. This results in droplet jets lying approximately on a conical surface area. Since the droplet jets are output in a preferred direction, the air surrounding the droplet jet is entrained. The increased air exchange enables the energy required for the solidification to be dissipated better. This results in a further increase in the effectiveness of the snow lance according to the invention.

If a plurality of nucleator nozzles is used, said nucleator nozzles are advantageously arranged uniformly over the circumference of the cylindrical lance body. At the same time, in this case, if a plurality of water nozzles is used, said water nozzles are also distributed over the circumference of the lance body. With arrangements of this type, particularly homogeneous snow-making results can be obtained.

According to another particularly preferred embodiment, the lance body is provided with two different groups of water nozzles. The water nozzles of the two groups are arranged in two different axial positions on the lance body. The different axial position results in the droplet sections of the water droplets produced by the water nozzles of the different groups being different. Such an arrangement permits longer or shorter droplet sections to be selected consciously, depending on the external temperature. In this case, it is particularly advantageous if the groups of water nozzles can be charged with water individually in the different positions. At lower ambient temperatures, relatively short droplet sections are sufficient. The water nozzles which are located closer to the nucleator nozzles are then additionally charged with water. At higher temperatures, the group of water nozzles located further away from the nucleator nozzle is charged with water. This produces a relatively large droplet section. More time is therefore required to cool the water droplets.

The respective water nozzles of the at least two groups of water nozzles can be oriented in such a manner that the droplet jets produced with the water nozzles strike against the ice nuclei jet only when the ice nuclei section is at least 10 cm, in particular 20 to 30 cm.

For certain use purposes, it may be advantageous if at least one group of water nozzles is arranged axially below the at least one nucleator nozzle, and if at least one additional group of water nozzles is provided, said group being arranged above the at least one nucleator nozzle. Said additional water nozzles can further increase the snow-making capacity.

In particular if a plurality of nucleator nozzles is used, for example if six nucleator nozzles are used, it has proven advantageous for the nucleator nozzles to be offset with respect to the water nozzles on the lance body, as seen in the circumferential direction. This results in particularly effective thorough mixing in the germination zone.

In another embodiment, in order to predetermine a mixing chamber, the snow lance can contain a preferably approximately hollow cylindrical tubular part to which the at least one nucleator nozzle is connected in terms of flow. In this case, the tubular body can be arranged in the lance body preferably axially parallel to the lance body axis, thus enabling a slender design to be achieved for the snow lance.

A common feed pipe can be provided in order to feed the at least one nucleator nozzle and the at least one water nozzle.

Another aspect of the invention relates to a method for producing ice nuclei for producing artificial snow. In particular, a nucleator nozzle as described above is used. In this case, a stream of water and compressed air is conducted through a nozzle channel. The nozzle channel is reduced in a first section to a core diameter. The nozzle channel expands again in a second section toward an outlet opening. According to the method according to the invention, the stream is conducted in the expanding region at a pressure of less than 0.6, preferably of approximately 0.2 bar. In addition, downstream of the exit from the outlet opening, pressure surges are produced in the emerging medium. It is assumed that said pressure surges serve to initiate the solidification of the ice nuclei and therefore permit the energy to be input for solidification purposes to be reduced.

Yet another aspect of the invention relates to a method for producing artificial snow. According to said method, ice nuclei are produced in at least one nucleator nozzle and water droplets are produced in at least one water nozzle by atomizing water. A nucleator nozzle as described above is typically used. The droplet jet produced with the water nozzle and the ice nuclei jet produced with the nucleator nozzle are brought together in a germination region. According to the invention, the ice nuclei jet is conducted via an ice nuclei section of at least 10 cm, preferably approximately 20 to 30 cm. As an alternative or in addition, the droplet jet is conducted via a droplet section of at least 20 cm, preferably approximately 40 to 80 cm.

According to a preferred development of the method according to the invention, as a function of the wet bulb temperature of the surroundings, in a first temperature range water droplets are produced by water nozzles at a first distance from the nucleator nozzle. In a second, lower temperature range, water droplets are produced from water nozzles which are arranged at a second distance from the nucleator nozzle, which distance is smaller than the first distance. In this manner, an optimum droplet section can be selected depending on the wet bulb temperature of the surroundings.

The droplet jet of the additional water nozzles can be conducted to a germination region via a droplet section of at least 20 cm, in particular 40 cm to 80 cm.

As an alternative or in addition, the droplet jet of the additional water nozzles can be conducted to a second germination region via a droplet section of at least 20 cm, in particular 40 cm to 80 cm, where droplets, which have already frozen, from the water nozzle groups and/or ice nuclei, which are still present, from the nucleator nozzle seed the droplets in a type of secondary germination and therefore enable the freezing of said droplets.

Figure 2:
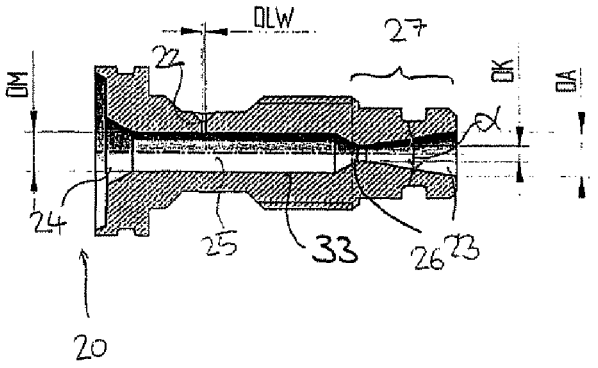
Figure 3:
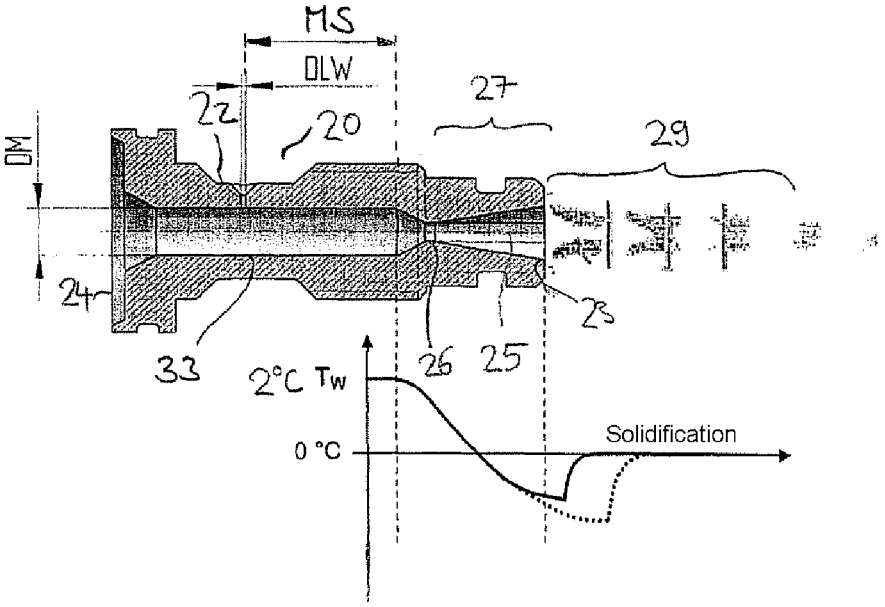
Figure 4:
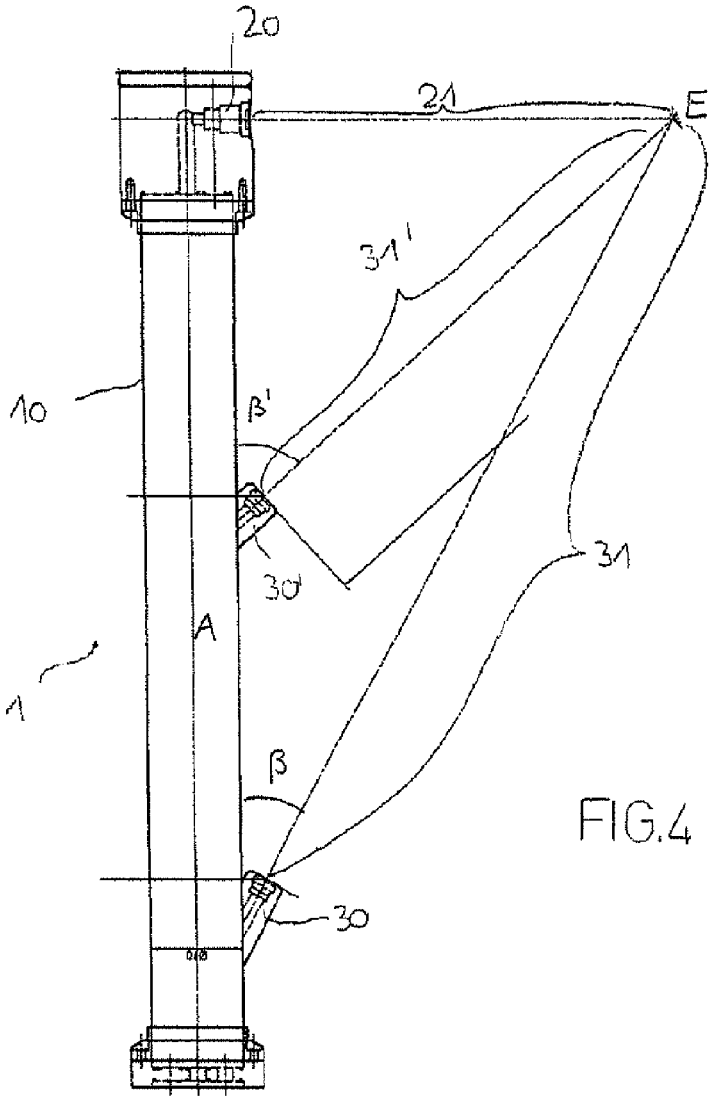
Figure 5:
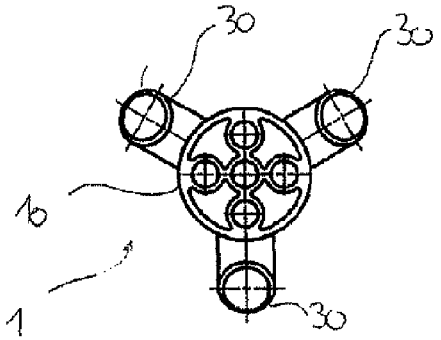
Figure 6:
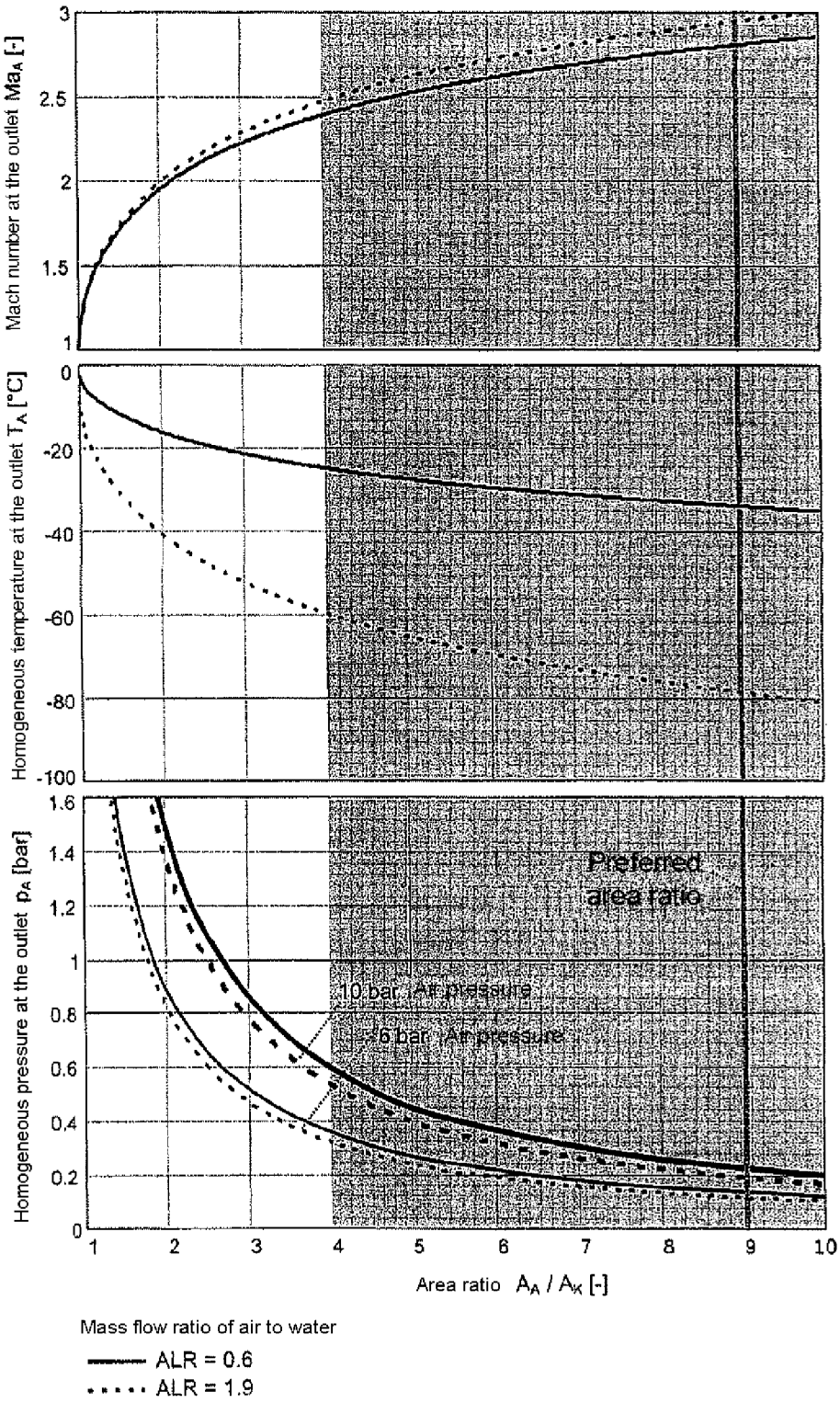
Figure 7:
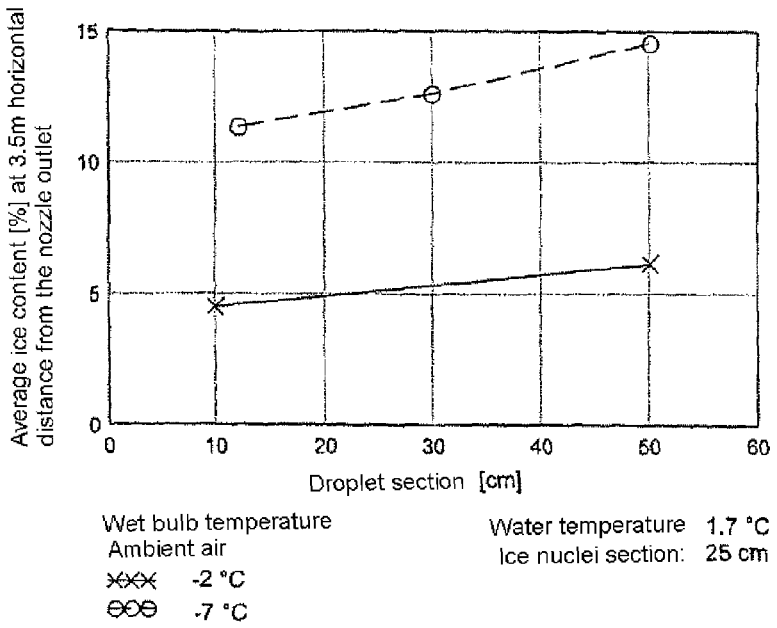
Figure 8:
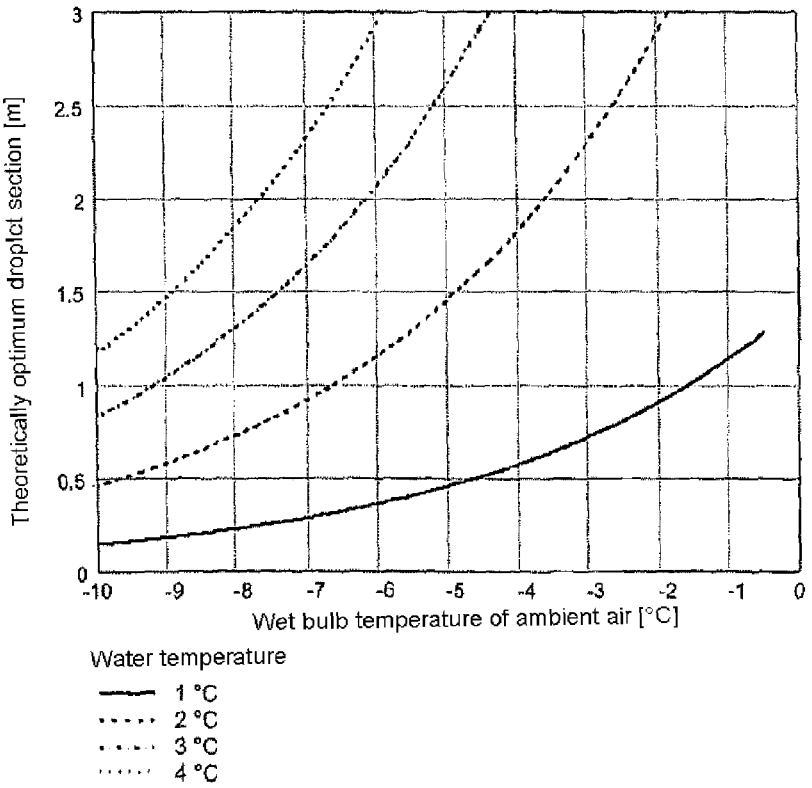
Figure 9:
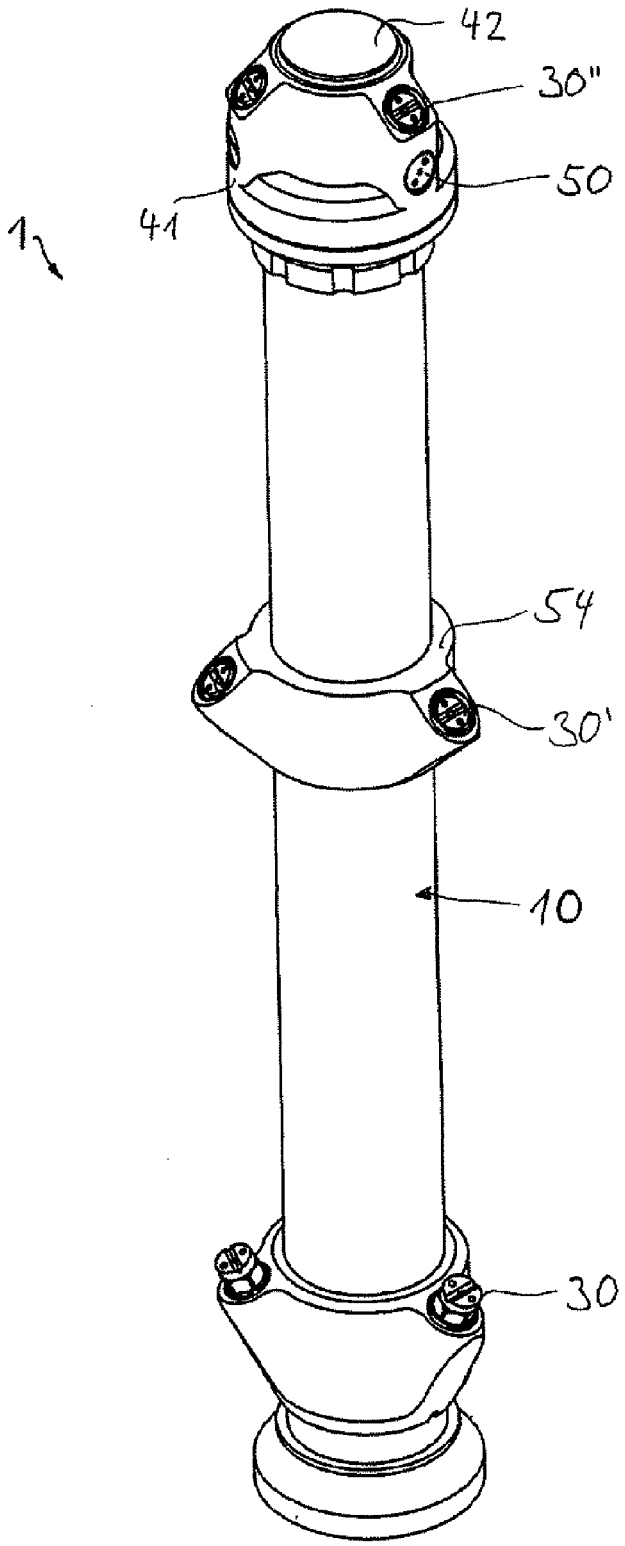
Figure 10:
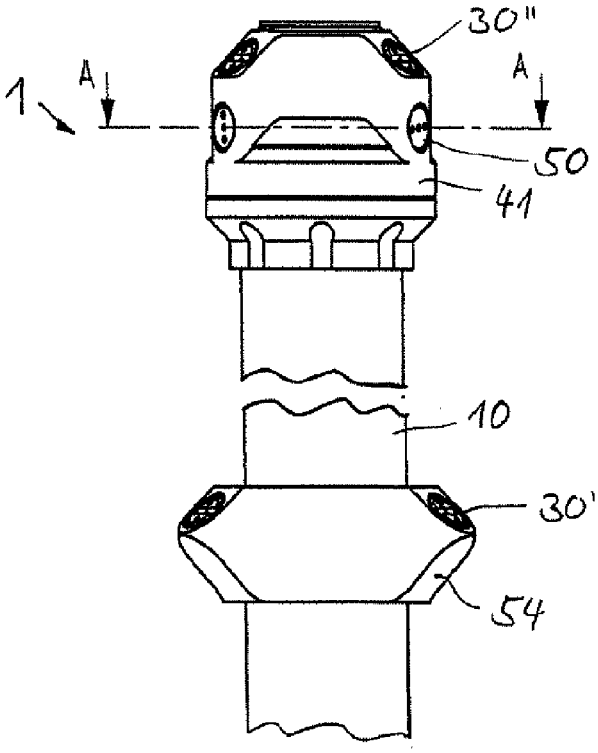
Figure 11:
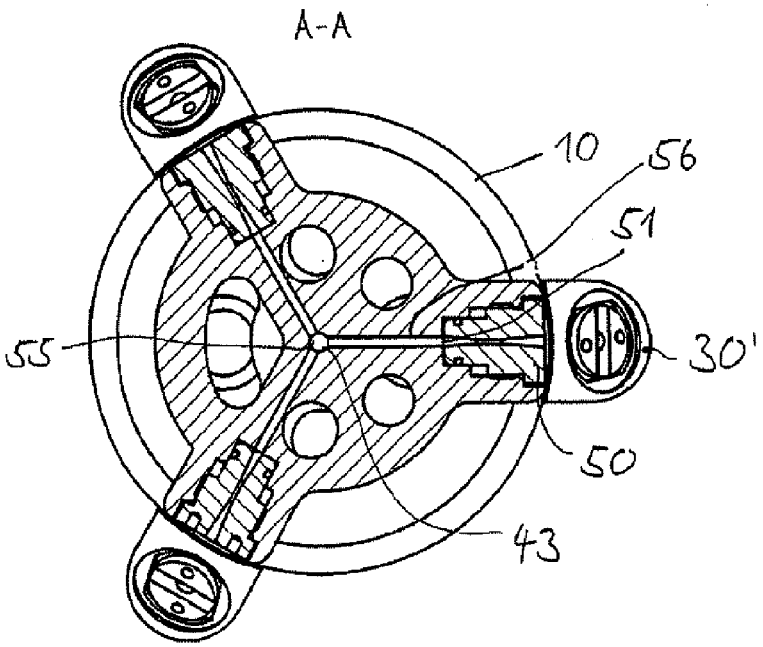
Figure 13A:
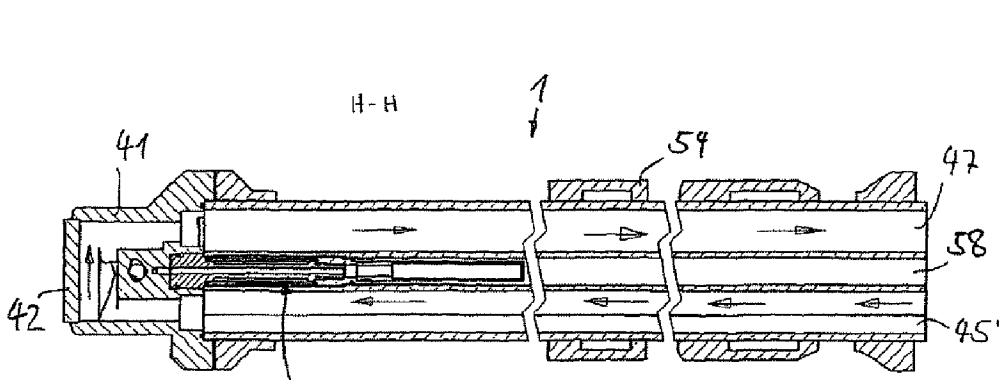
Figure 12:
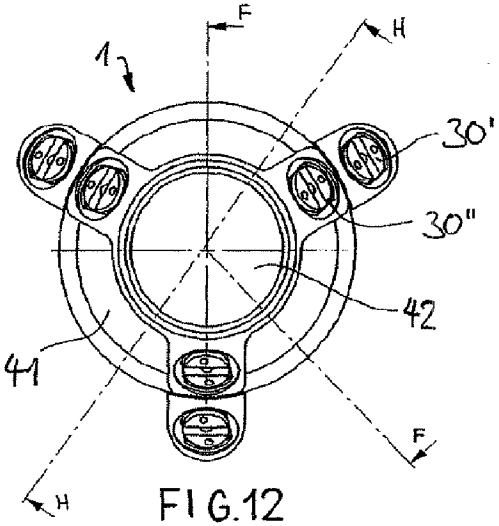
Figure 13:
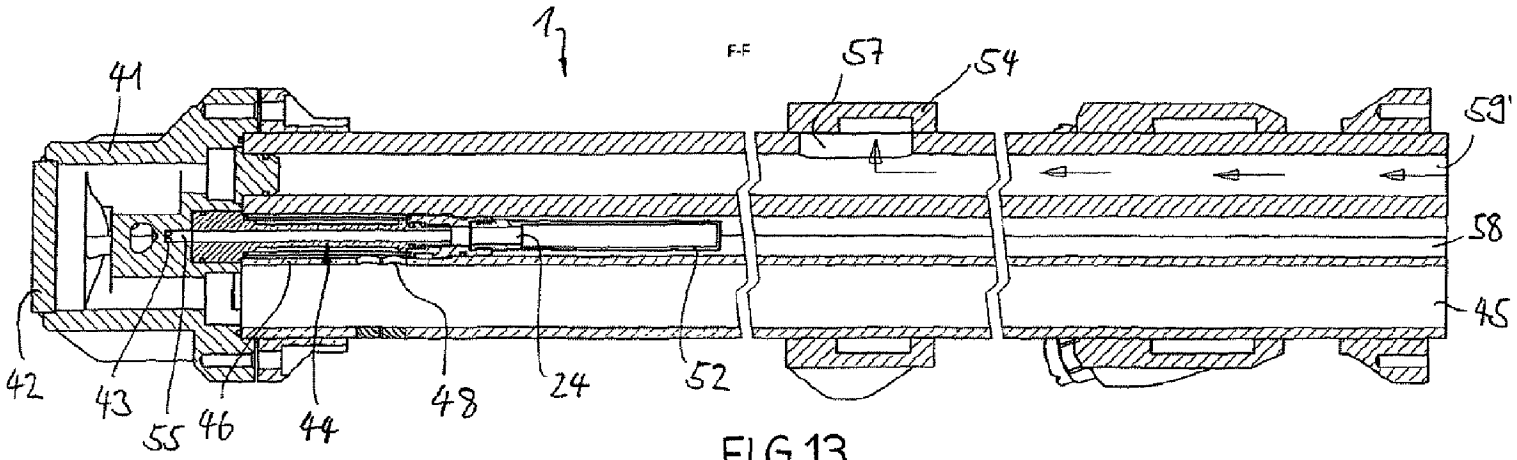
Figure 14:
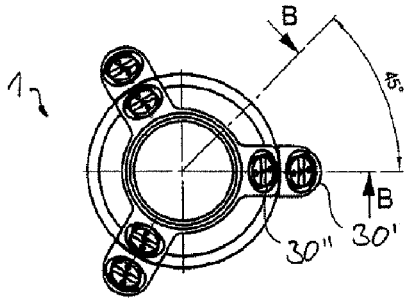
Figure 15:
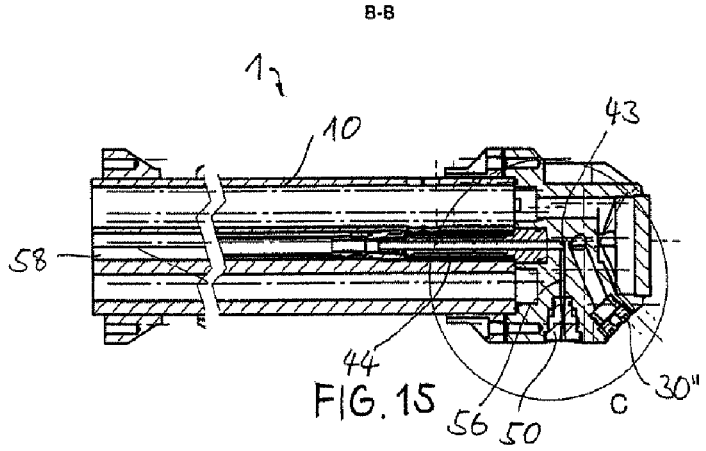
Figure 16:
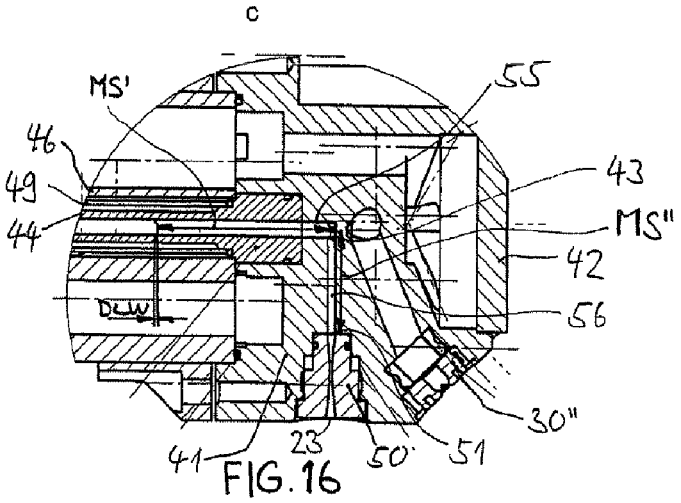
Figure 17:
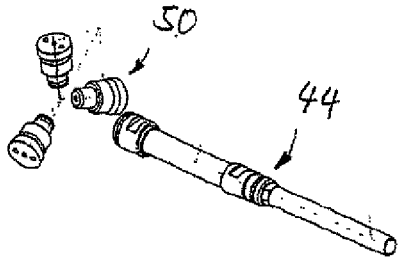
Figure 18:
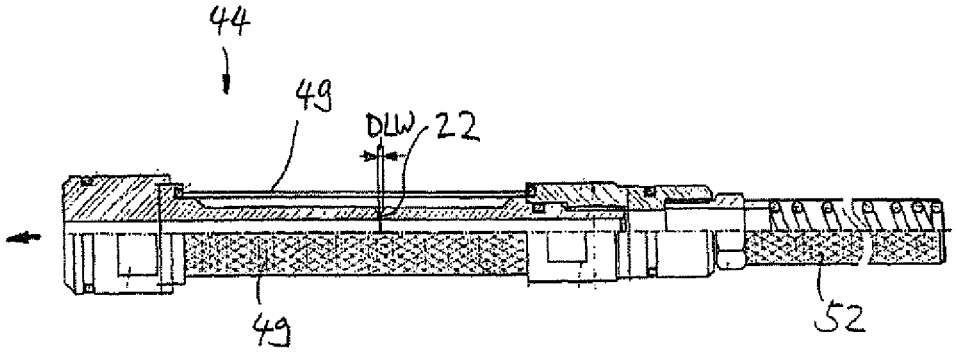
Figure 19:
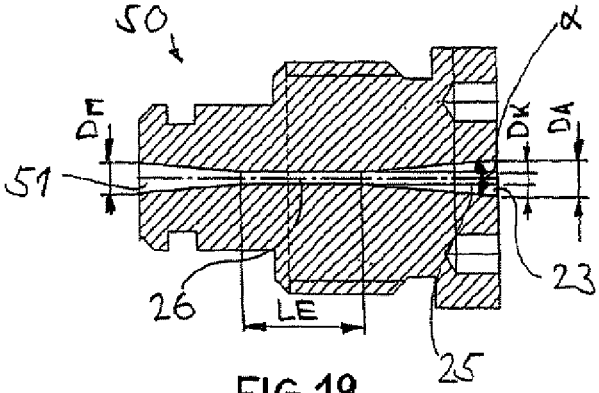
Figure 20:
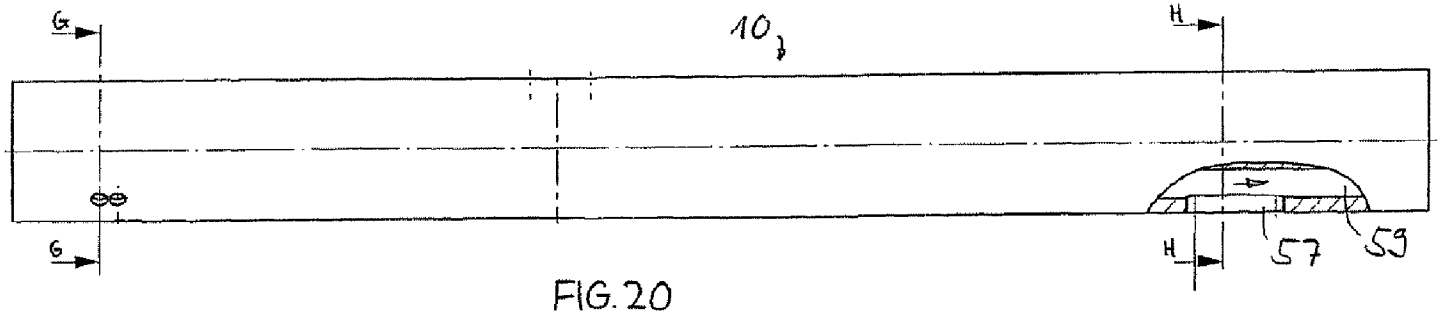
Figure 22:
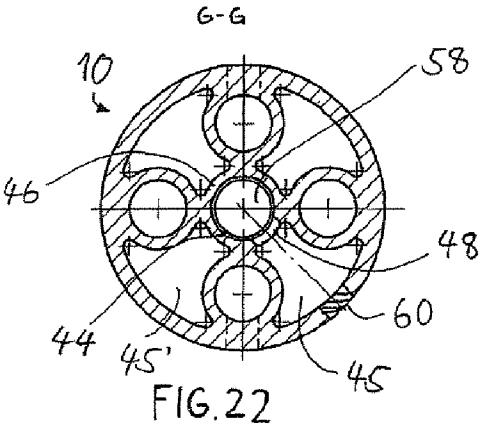
Figure 21:
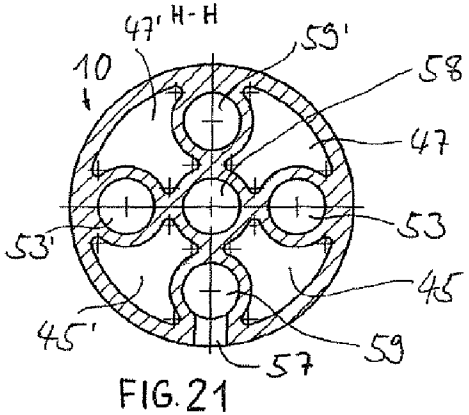

The invention is explained in more detail below in exemplary embodiments and by way of the drawings, in which:

FIG. 1: shows a schematic illustration of a snow-making process;

FIG. 2: shows a cross section through a nucleator nozzle according to the invention;

FIG. 3: shows the course of the water temperature in the nucleator nozzle according to FIG. 2;

FIG. 4: shows a side view of a snow lance according to the invention;

FIG. 5: shows a section through the snow lance according to FIG. 4 along a plane perpendicular to the axis of the snow lance;

FIG. 6: shows the Mach number; homogeneous temperature and homogeneous pressure at the outlet of a nucleator nozzle according to the invention as a function of the area ratio between the core diameter and outlet opening;

FIG. 7: shows a graphical illustration of the ice content as a function of the droplet section in a snow lance according to the invention, FIG. 8: shows a theoretically optimum droplet section as a function of the water temperature and the wet bulb temperature of the ambient air;

FIG. 9: shows a perspective illustration of an upper part of a snow lance according to a second exemplary embodiment, FIG. 10: shows a side view of the upper end of the snow lance according to FIG. 9, FIG. 11: shows a cross section through the snow lance in the region of the nucleator nozzles (section line A-A according to FIG. 10), FIG. 12: shows a top view of the snow lance according to FIG. 9, FIG. 13: shows a sectional illustration of the snow lance along the section line F-F according to FIG. 11, FIG. 13*a*: shows a sectional illustration of the snow lance along the section line H-H according to FIG. 11, FIG. 14: shows a further plan view of the snow lance together with the illustration of a further section line, FIG. 15: shows a sectional illustration of the uppermost end of the snow lance along the section line B-B according to FIG. 14, FIG. 16: shows a detail C from FIG. 15, FIG. 17: shows a perspective illustration of a tubular part and three nucleator nozzles for the snow lance according to FIG. 9, FIG. 18: shows a side view with a partial section of the tubular part in an enlarged illustration, FIG. 19: shows a cross section through the nucleator nozzle according to FIG. 17 in a greatly enlarged illustration, FIG. 20: shows a side view of a lance body for the snow lance, FIG. 21: shows a cross section through the lance body (section line H-H according to FIG. 20), and FIG. 22: shows a further cross section through the lance body (section line G-G according to FIG. 20).

FIG. 1 shows schematically the production of artificial snow with a snow lance. Ice nuclei 28 are produced in a nucleator nozzle 20 or 50. Water droplets 32 are produced in a water nozzle 30. The water droplets 32 move to a germination zone E via a droplet section 31. The ice nuclei 28 move to the germination zone E via an ice nuclei section 21. In the germination zone E, the water droplets 32 come into contact with the ice nuclei 28 and are seeded. On the route via the droplet section 31, the water droplets 32 which are atomized by the water nozzle 30 are cooled. The water droplets seeded with ice nuclei subsequently solidify in a solidification zone 40 and, after a dropping height H of approximately 10 meters, typically fall to the ground as snow.

FIG. 2 shows in cross section a nucleator nozzle 20 according to the invention. The nucleator nozzle 20 has a lateral water inlet opening 22 and an axial compressed air inlet opening 24. The water inlet opening 22 opens approximately perpendicularly into a nozzle channel 25. The compressed air inlet opening 24 lies on the axis of the nozzle channel 25.

The nucleator nozzle 20 is designed as a convergent-divergent nozzle. That is to say, the nozzle channel 25 tapers in diameter in a first section to a core diameter 26. In a second, expanding region 27, the nozzle channel 25 expands again from the core diameter 26 to an outlet opening 23.

In the exemplary embodiment shown in FIG. 2, the nozzle channel is designed with a round cross section. The diameter DM of the compressed air inlet opening 24 is 2.0 mm. The diameter DLW of the water inlet opening 22 is 0.15 mm. The cross sectional diameter DK of the nozzle channel 25 in the region of the core diameter 26 is 0.85 mm while the cross sectional diameter DA of the nozzle channel 25 in the region of the outlet opening 23 is 2.5 mm. According to the invention, the ratio between the cross sectional area in the region of the outlet opening 23 and in the region of the narrowing 26 is selected to be as high as possible. In the present exemplary embodiment, the ratio is approx. 9:1.

During correct operation of the nucleator nozzle, air is introduced through the compressed air inlet opening 24 at a pressure of 6 to 10 bar (absolute air pressure) in a quantity of up to at maximum 50 standard liters (standard 1) per minute. When typically 6 nucleator nozzles are used per lance, a maximum air consumption of 300 standard liters (standard 1) per minute is produced. Water is introduced through the water inlet opening 22 at a pressure of between 15 and 60 bar (absolute air pressure) into the nozzle channel 25. With the abovementioned pressures, mass flow ratios of the mass flow of air and water of approx. 0.6 to 1.9 are produced in the nucleator nozzle. However, in certain cases, mass flow ratios of the mass flow of air and water of 0.3 to 1.7 are also conceivable.

In the area ratio shown in FIG. 2 between the taper 26 and outlet opening 23 and at a full cone angle $\alpha$ of approx. 20° in the expanding region 27, a pressure of approx. 0.2 bar is produced in the expanding region 27 with the abovementioned operating parameters. With the area ratio remaining constant, the angle $\alpha$ can be selected as desired within a certain range, but smaller angles are preferred. The associated longer residence time in the nozzle allows the entrained water droplets more time to cool.

FIG. 3 shows schematically the operation of the nucleator nozzle 20 from FIG. 2 for producing ice nuclei. In the example adopted in FIG. 3, the water temperature $T_W$ is originally approximately 2° C. By means of the cross sectional narrowing and subsequent widening, the water is cooled by the compressed air. Cooling takes place to typically −1° C. to −2° C. Said cooling is less than the cooling of −8° C. to −12° C. aimed for with conventional nucleator nozzles. Accordingly, the consumption of compressed air is significantly smaller with the nucleator nozzle 20 according to the invention.

Owing to the specific selection of the geometry in the widening region 27, a relatively large negative pressure is produced up to the outlet opening 23. At the same time, pressure-compensating surges are formed in a specific manner in the region 29, said surges assisting the formation of the ice nuclei and initiating solidification. MS denotes a mixing section for the air-water mixture of the mixing chamber of the nozzle channel 25. In the present exemplary embodiment, the mixing section MS is approximately 3.5 times larger than the diameter DM of the nozzle channel in the region of the mixing section. Relatively long mixing sections lead to an advantageous, finely dispersed droplet flow.

The nucleator nozzle shown in FIG. 2 may in principal be used for producing ice nuclei in snow guns or in snow lances.

FIG. 4 shows a snow lance 1 which is provided with three nucleator nozzles 20 (only one nucleator nozzle 20 is visible in the side view in FIG. 4). The snow lance 1 has a lance body 10. The lance body 10 is substantially formed with a cylinder geometry. At one end of the lance body 10, the nucleator nozzles 20 are arranged such that they are directed radially outward over the circumference of said lance body.

In addition, two groups of water nozzles 30, 30' are arranged on the lance body 10. In the side view in FIG. 4, only one water nozzle of one group is in each case visible. Typically, three water nozzles 30 or 30' per group are arranged uniformly at a distance of 120° over the circumference of the lance body 10.

The water nozzles 30 or 30' are arranged inclined with respect to a plane perpendicular to the axis A of the lance body 10. In this case, the angle $\beta$ of the water nozzles 30 arranged further from the nucleator nozzle 20 is selected to be smaller than the angle $\beta'$ of the water nozzles 30' located closer to the nucleator nozzle 20. Typically, the angle $\beta$ of the water nozzles 30 is approximately 30° and the angle $\beta'$ of the water nozzles 30' is approximately 50°.

After exiting from the nucleator nozzle 20, ice nuclei pass through an ice nuclei section 21. After passing through a droplet section 31 or 31', the water droplets produced with the water nozzles 30 or 30' meet ice nuclei in the germination zone E.

In the exemplary embodiment shown, the droplet section 31 is approximately 70 cm. The droplet section 31' is approximately 50 cm. The ice nuclei section 21 is approx. 25 cm.

Owing to the water nozzles 30 or 30' being arranged relatively far from the nucleator nozzles 20, relatively large droplet sections 31 or 31' are produced. The water droplets formed with the water nozzles 30 or 30' therefore have sufficient time to cool to the necessary temperature. In principle, the droplet section 31, 31' and the ice nuclei section 21 can be selected to be of any length above a lower limit of typically approximately 20 cm. The upper limit is provided by the jets still having to meet in the germination region E. Depending on the field of application, it may therefore be expedient to design the nucleator nozzle 20 as a circular jet nozzle (i.e. with a round cross section in the outlet region) or as a fan jet nozzle (i.e. with an elliptical cross section in the outlet region).

The arrangement of the water nozzles 30 or 30' in two groups at different distances from the nucleator nozzle 20 permits different operating modes depending on the wet bulb temperature of the surroundings. Typically, both groups of water nozzles 30 and 30' are used at lower wet bulb temperatures. At lower temperatures, a shorter droplet section 31' is sufficient. At higher wet bulb temperatures, only the water nozzles 30 which are further away are used. Owing to the longer droplet section 31, sufficient cooling is nevertheless ensured.

At operating pressures of 15 to 60 bar, the water consumption of a nozzle 30 or 30' is customarily between 12 and 24 liters of water per minute. In the exemplary embodiment, at high wet bulb temperatures of the surroundings of typically −4° C. to −1° C., snow can be made with three water nozzles 30 of the groups which are further away and using approx. 36 to 72 liters of water per minute. After the water nozzles 30' of the closer group are switched on below typically −4° C., consumption of approx. 72 to 144 liters of water per minute is produced. For even lower temperatures, at least one further water nozzle group is provided, but is not shown here.

Means of supplying air and water for the individual nozzles are arranged in the lance body 10 in a manner known per se. Such supply means are customary for a person skilled in the art. They are therefore not described in detail here.

The various components described are manufactured from metal. Partially anodized aluminum is typically used for the body of the nucleator nozzle and of the water nozzle and also of the snow lance.

FIG. 5 shows a section through a plane perpendicular to the axis A of the lance body. The lance body 10 is of substantially cylindrical design. Three water nozzles 30 are arranged regularly over the circumference of the lance body 10 at an angular spacing of 120°. Various supply lines (not described specifically) for air and water are shown in the interior of the lance body 10.

FIGS. 6 to 8 show various measurement results from which the significantly greater efficiency of the nucleator nozzle and snow lance according to the invention is apparent.

FIG. 6 shows a Mach number, the homogeneous temperature and the homogeneous pressure in the medium in the region of the outlet opening 23 of the nucleator nozzle 20 (see FIG. 2) as theoretical values. Homogeneous here means that the temperatures of air and water in the nozzle have already been fully equalized. In reality, this will never be the case. The temperatures shown here are therefore significantly lower than the anticipated water temperatures. The geometry of the nucleator nozzle 20 is selected in such a manner that the Mach number lies within the range of at least approximately 2 to 2.5. In the region of the outlet opening, the pressure in the emerging medium is approximately 0.2 to 0.6 bar. The specified pressure and temperature values and the Mach number depend on the area ratio $A_A/A_K$ between the cross sectional area in the region of the outlet opening 23 and in the region of the narrowing 26. The area ratio found to be preferred on the basis of tests is approx. 9:1.

In the lowermost illustration in FIG. 6, two different curves are also shown as a function of the air pressure in the nucleator nozzle 20. Comparable results are produced at an air pressure of 6 bar and at 10 bar.

All three illustrations according to FIG. 6 also show the curves for two different mass flow ratios ALR between the air and water. Said mass flow ratios lie within the above-mentioned operating range limits which arise from the typically prevailing pressure ranges of water and air and from the geometry.

FIG. 7 shows the average ice content in percent in a region at a horizontal distance of approx. 3.5 m downstream of the nozzle outlet. The ice content increases if the droplet section increases. Given a fixed ice nuclei section 21 of 25 cm and a water temperature of 1.7° Celsius, at a wet bulb temperature of the surroundings of −2° C. an ice content which rises from approx. 4.5% to approx. 6% is produced in a droplet section of 10 or 50 cm. The effect is even more pronounced at a lower wet bulb temperature of −7° C.: in this case, if the droplet section is lengthened from approx. 10 to 50 cm, the ice content increases from approx. 12 to virtually 15%.

FIG. 8 also shows the theoretically optimum droplet sections, which are determined by experimentation, as a function of various water temperatures for various wet bulb temperatures. The theoretically optimum droplet section is understood as meaning the section in which the water droplets from the water nozzles 30 and 30' can be cooled precisely to 0° C. This ensures that no more ice nuclei are melted during the encounter in the germination zone, and therefore the best snow-making results should be expected. As FIG. 8 shows, optimum snow-making can be achieved with a water temperature of 1° Celsius with a droplet section in the region of 50 cm to 1 m and at a wet bulb temperature of the surroundings of up to −2° C.

FIG. 9 shows a further snow lance 1 which differs from the snow lance according to FIG. 4 inter alia in that additional water nozzles 30" are arranged above the nucleator nozzles, which are denoted by 50. The water nozzle and nucleator nozzle geometry is essentially the same. The snow lance therefore differs by comparatively long ice nuclei sections and droplet sections. The ice nuclei section here is also intended to be at least 10 cm, in particular approximately 20 to 30 cm and the respective droplet sections of the water nozzles 30 and/or 30' are intended to be at least 20 cm, in particular approximately 40 to 80 cm. The droplets of the additional water nozzles 30" are seeded in a second germination zone by means of already frozen droplets from the water nozzles 30 and/or 30' and remaining ice nuclei from the nucleator nozzles (20/50). The snow lance 1 has an alternative arrangement, which is described in more detail below, for producing ice nuclei.

As emerges from FIG. 10, the nucleator nozzles 50 are fastened in a head part 41. By way of example, the fastening takes place via a screw connection. To screw in the nozzle 50, two blind holes can be seen next to the outlet opening 23 as workpiece receptacles (cf., for example, FIG. 19 below). Said head part 41 is screwed on to the lance body.

As emerges from FIG. 11, the three nucleator nozzles 50 of the arrangement for producing ice nuclei are fed by a common channel. A water-air mixture can be conducted through said channel, the mixture dividing in the channel division 43 and being supplied to the nucleator nozzles 50. A nozzle inlet opening of the nozzle channel of the nucleator nozzle 50 is denoted by 51. Said nucleator nozzles 50 differ from the nucleator nozzles according to the first exemplary embodiment (cf. FIGS. 2, 3) particularly in that the water is not conducted into the nozzle channel via a lateral, separate input opening. The basic conception of the nozzle channel geometries of the nucleator nozzles 50 remain more or less the same. The nucleator nozzle 50 is therefore likewise configured as a convergent-divergent nozzle in which the ratio of the cross sectional area of the outlet opening to the cross sectional area of the nozzle channel in the region of the core diameter is at least 4:1 and preferably approximately 9:1. The individual nucleator nozzles are each connected in terms of flow to supply channels 56 which are connected to a central channel 55 in the region of the channel division 43. It can furthermore be readily seen in FIG. 11 that the water nozzle 30' is configured as a fan jet nozzle.

It can be seen from the top view according to FIG. 12 (and also from FIG. 14) of the snow lance 1 that the three water nozzles 30' and 30" in each case (and of course also the nucleator nozzles which cannot be seen here) are distributed over the circumference of the lance body 10.

FIG. 13 shows a longitudinal section through the snow lance 1. In order to form a mixing chamber, a tubular part 44 which is of approximately hollow cylindrical design and into which compressed air can be supplied via a compressed air inlet opening 24 is provided. The water is conducted from the side into the mixing chamber of the tubular part 44. The tubular part 44 is surrounded on the surface area side by an outer tube 46 which has two bores 48 for the entry of water. A sleeve-shaped filter element 49 is arranged between the outer tube 46 and the tubular part 44 (cf. FIG. 18 below). As can be seen, water for all of the nucleator nozzles is injected via a common mixing chamber. Furthermore, the arrangement has a common central water filtering means 49 for the three nucleator nozzles. This has the advantage that—in comparison to the arrangement according to the first exemplary embodiment as per FIG. 2—a comparatively large water inlet opening can be selected. This has advantages inter alia in terms of production. However, a further advantage consists in the filtration of the supplied water being able to be simplified. The mixing chamber system according to the second exemplary embodiment enables, for example, the coarser and larger filter to be used.

It is apparent with reference to FIGS. 13 and 13*a* how the water is conducted through the snow lance and the water and nucleator nozzles are fed. It can be seen in FIG. 13*a* how the water is conducted in 45' (and 45) upward into the head part where it is deflected. In this case, the water feeds the nucleators and at the same time icing up is prevented by the head being heated. The water is then conducted again to the foot of the lance where it can be distributed into three channels by means of valves and can be conducted upward again (see FIGS. 20-22). The direction of the water mass flows is indicated by arrows. The three groups of water nozzles (30, 30', 30") can each be charged individually with water by means of valves (not illustrated). A channel 59' which extends in the axial direction of the lance body and serves to feed the upper water nozzles (30') can be seen in FIG. 13. A cutout in the outer casing of the lance body, via which the water can pass into an annular channel, formed by an annular element 54, is denoted by 57. The annular element 54 has recesses on the circumference, into which the water nozzles can be screwed (cf., for example, FIG. 9 or 10). The nozzles 30 are also fed in the same manner by an annular channel. A compressed air supply pipe is denoted by 58. The compressed air passes from said channel 58 via a candle filter 52 into the tubular part 44.

FIGS. 15 and 16 show the snow lance 1 in a further longitudinal section, the snow lance being depicted true to scale in FIG. 16. The design of the nozzle channel of the arrangement for producing ice nuclei can in particular be readily seen therefrom. The water-air mixture is conducted along a first mixing section MS' to the channel division 43. Said mass flow is then deflected and divided until it finally passes through the respective nozzle channels of the nucleator nozzles 50 to the outlet opening 23. In this case, the mixing section MS' is approximately 12 times larger than the diameter of the nozzle channel in the region of the mixing section. Particularly advantageous results can be obtained if the entire mixing section MS'+MS" is at least 12 times larger than the diameter of the nozzle channel in the region of the mixing section. It has been shown that a mixing section which is at least three times larger than the diameter of the nozzle channel in the region of the mixing section MS' may be advantageous. The mixing chamber of the tubular part is adjoined by a short channel 55 which is assigned to the head part and has the same channel diameter, said channel being divided into three channels 56. The channels 56 (mixing section MS") and therefore also the nucleator nozzles 50 are oriented at a right angle to the tubular part 44. In the present example, the cross sectional area in the region of the mixing section MS' is approximately 7 times larger than the overall cross sectional area of the three nucleator nozzles in the region of the core diameter.

FIG. 17 shows the tubular part 44 and the three nucleator nozzles 50 of the arrangement for producing ice nuclei for the snow lance in a type of exploded illustration.

Details of a tubular part 44 can be gathered from FIG. 18. The water inlet opening 22 is arranged here approximately centrally in the tubular part 44 with respect to the axial direction. The filter element 49 may be composed of a wire mesh. A central filtering means of this type may be configured to be relatively coarse, as a result of which the range of use can be expanded. The mesh width of a wire fabric filter (or hole width in general) may be, for example, approximately 0.1 mm. As can be seen, the filter element 49 is spaced apart from the outer wall of the tubular part 44, as a result of which an annular gap is formed. The water finally passes from the annular gap via the water inlet opening 22 in the tubular part 44 into the mixing chamber and is entrained by the compressed air stream and mixed therewith. The diameters of the bores 48 are many times larger than the diameter of the water inlet opening 22. The diameter, denoted by DLW, of the water inlet opening 22 may be, for example, 0.25 mm or 0.5 mm, depending on the intended use. A candle filter 52 is arranged in the region of the compressed air inlet opening 24 in order to clean the air brought up to this point.

Structural details of a nucleator nozzle 50 can be gathered from FIG. 19. The nozzle 50 is designed as a single-piece component which has an external thread with which the nozzles can be fastened into corresponding receptacles on the head part. The present nozzle has the following characteristic data by way of example: outlet diameter $D_A$=2.5 mm, core diameter $D_K$=0.85 mm and inlet diameter $D_M$=2.1 mm. The diameter of the channel (56) (not shown here) opening into the nozzle is 2.0 mm. The length, denoted by LE, of the narrowest cross section is approx. 5.4 mm. Owing to the relatively long channel section with the narrowest cross section (LE) and because of the comparatively long outlet cone, the water droplets have sufficient time for cooling, as a result of which the production of ice nuclei can be optimized.

FIG. 20 shows a lance body 10. FIGS. 21 and 22 show a section through the lance body in two different axial positions. The lance body 10 is as a hollow profile extending in the axial direction and containing five circular cavities 53, 53', 58, 59, 59' and four non-circular cavities 45, 45', 47, 47'. In this case, the central cavity 58 serves as a supply pipe for the compressed air for the nucleator nozzles. In the cavities 45 and 45', water is conducted upward to the lance head (not shown here) where it is deflected. The water is then conducted downward via the cavities 47, 47' to a valve arrangement (not shown). Depending on activation, the water passes to the round channels 59 and/or 59' which feed the water nozzles arranged below the nucleator nozzles. An elongated hole 57 which produces the connection between the cavity or channel 59 and the lower water nozzles (30) (not shown here) in terms of flow can be seen in FIG. 21. The cavity or channel 59' serves for feeding the upper water nozzles (30'). The channels 53 and 53' serve to feed the additional water nozzles (30") which are arranged above the nucleators.

It can be seen from FIG. 22 and FIG. 20 how the bore 48 with which water can be supplied to the tubular part 44 for feeding the nucleators, can be produced. Said bores can be produced in a simple manner by a drilling operation from the outside of the lance body. The holes produced in the process on the outer casing of the lance body 10 then merely have to be closed. FIG. 22 indicates a filling of the holes by a shaded area 60.

The invention claimed is:

1. A snow lance comprising:

a body defining a longitudinal axis, at least one ice nucleator nozzle mounted on the body, and said at least one nucleator nozzle being directed radially away from said axis for generating an ice nuclei jet, a first group of water nozzles disposed on said body around said axis, at a first axial distance from said at least one nucleator nozzle, a second group of water nozzles disposed on said body around said axis, at a second axial distance away from said at least one nucleator nozzle, with the second axial distance being smaller than said first axial distance, first and second water channels for independently feeding water to said first and second groups of water nozzles, respectively, the water nozzles of said first group being inclined at a first angle with respect to said axis, and the water nozzles of said second group being inclined at a second angle with respect to said axis, and said first angle being smaller than said second angle so that the nucleator nozzle and all of said water nozzles are directed at a common germination zone around said axis, wherein said nucleator nozzle is a convergent-divergent nozzle which has a compressed air inlet, a water inlet, an outlet, and a channel extends between said air inlet and said outlet, said channel has a converging section, a core section and a diverging section, and the diverging section has a ratio of at least 4:1 between its cross sectional area at the outlet to its cross sectional area at the core section.

2. The snow lance of claim 1, wherein said body is substantially cylindrical.

3. The snow lance as claimed in claim 1, wherein said ratio is at least 9:1.

4. The snow lance of claim 1, wherein the first angle with respect to the axis and the second angle with respect to the axis are both between 0° to 45°.

5. The snow lance of claim 1, wherein a plurality of said nucleator nozzles are distributed around a circumference of the body.

6. The snow lance of claim 1, wherein a plurality of water nozzles of the first group are distributed around a circumference of the body.

7. The snow lance of claim 1, wherein a plurality of water nozzles of the second group are distributed around a circumference of the body.

8. The snow lance of claim 1, wherein all of the water nozzles of the second group are oriented such that droplet jets, produced by the water nozzles of the second group, only strike against the ice nuclei jet after passing along a droplet section having a length of at least 20 cm.

9. The snow lance of claim 1, wherein all of the water nozzles of the second group are oriented such that droplet jets, produced by the water nozzles of the second group, only strike against the ice nuclei jet after passing along a droplet section having a length of approximately 40 to 80 cm.

10. The snow lance of claim 1, wherein the water nozzles of the first group and the water nozzles of the second group are oriented such that droplet jets, respectively produced by the water nozzles of the first group and the water nozzles of the second group, only strike against the ice nuclei jet in a common germination zone.

11. The snow lance of claim 1, wherein the at least one ice nucleator nozzle has an ice nuclei section with a length of at least 10 cm, the water nozzles of the first group are charged with water wet bulb temperatures between −1° C. and −4° C. and arranged such that a droplet section of the water nozzles of the first group has a length of approximately 40 to 80 cm, and the water nozzles of the second group are charged with water wet bulb temperatures below −4° C. and arranged such that a droplet section of the water nozzles of the second group has a length of less than the droplet section of the water nozzles of the first group.

12. The snow lance of claim 1, wherein the water nozzles of the second group are spaced from the at least one nucleator nozzle by a distance of at least 18 cm.

13. The snow lance of claim 1, wherein the water nozzles of the first group are spaced from the at least one nucleator nozzle by a distance of at least 35 cm.

14. A snow lance comprising:

a body defining a longitudinal axis, at least one ice nucleator nozzle mounted on the body, and said at least one nucleator nozzle being directed radially away from said axis for generating an ice nuclei jet, a first group of water nozzles disposed on said body around said axis, at a first axial distance from said at least one nucleator nozzle, second group of water nozzles disposed on said body around said axis, at a second axial distance away from said at least one nucleator nozzle, with the second axial distance being smaller than said first axial distance, first and second water channels for independently feeding water to said first and second groups of water nozzles, respectively, the water nozzles of said first group being inclined at a first angle with respect to said axis, and the water nozzles of said second group being inclined at a second angle with respect to said axis, and said first angle being smaller than said second angle so that the nucleator nozzle and all of said water nozzles are directed at a common germination zone around said axis, wherein the at least one ice nucleator nozzle comprises:

a nozzle channel having at least one compressed air inlet opening, at least one water inlet opening, and an outlet opening, a cross section of the nozzle channel tapers, in a direction toward the outlet opening, to a smaller diameter core diameter, between the cord diameter and the outlet opening the nozzle channel expands to a larger diameter, and a ratio of the cross section of the outlet opening to the cross section of the core diameter is at least 4:1.

15. The snow lance of claim 14, wherein the ratio of the cross section of the outlet opening to the cross section of the core diameter is at least 9:1.

16. The snow lance of claim 14, wherein the at least one ice nucleator nozzle has an ice nuclei section with a length of at least 10 cm, the water nozzles of the first group are charged with water wet bulb temperatures between −1° C. and −4° C. and arranged such that a droplet section of the water nozzles of the first group has a length of approximately 40 to 80 cm, and the water nozzles of the second group are charged with water wet bulb temperatures below −4° C. and arranged such that a droplet section of the water nozzles of the second group has a length of less than the droplet section of the water nozzles of the first group.

17. The snow lance of claim 14, wherein the water nozzles of the second group are spaced from the at least one nucleator nozzle by a distance of at least 18 cm.

18. The snow lance of claim 14, wherein the water nozzles of the first group are spaced from the at least one nucleator nozzle by a distance of at least 35 cm.

* * * * *